US005848648A

United States Patent [19]

Preiss

[11] Patent Number: 5,848,648

[45] Date of Patent: Dec. 15, 1998

[54] TITANIUM HORSESHOES

[76] Inventor: Mildred Preiss, 70 Salem Rd., Pound Ridge, N.Y. 10576

[21] Appl. No.: 588,567

[22] Filed: Jan. 18, 1996

Related U.S. Application Data

[63] Continuation-in-part of Ser. No. 309,254, Sep. 20, 1994, Pat. No. 5,564,492.

[51] Int. Cl.[6] ..... A01L 1/02

[52] U.S. Cl. ..... 168/4

[58] Field of Search ..... 168/4, 23

[56] References Cited

U.S. PATENT DOCUMENTS

| | | | |
|---|---|---|---|
| 2,136,215 | 11/1938 | Mabius | 168/4 |
| 4,091,871 | 5/1978 | Chiaramonte et al. | 168/4 |
| 4,215,750 | 8/1980 | Fields | 168/4 |
| 4,422,509 | 12/1983 | Mercer, II | 168/11 X |

FOREIGN PATENT DOCUMENTS

| | | | |
|---|---|---|---|
| 5076263 | 3/1993 | Japan | 168/4 |

*Primary Examiner*—Robert P. Swiatek
*Attorney, Agent, or Firm*—Evelyn M. Sommer

[57] ABSTRACT

An improved process for the preparation and fabrication of horseshoes whereby pure titanium or titanium alloys are processed with the exclusion of contaminating gases such as oxygen, nitrogen and hydrogen. The titanium horseshoes have many advantages over the present state of art such as light weight, higher tensile strength, flexibility, wearing resistance, abrasion resistance, hypoallergenic, workability, formability, friction-free, physiologically inert, and are easily formed and shaped into the desired configuration.

5 Claims, 1 Drawing Sheet

TITANIUM HORSESHOES

BACKGROUND OF THE INVENTION

This application is a continuation-in-part of my prior U.S. patent application Ser. No. 08/309,254 filed Sep. 20, 1994 issued to U.S. Pat. No. 5,564,492, which is hereby incorporated by reference.

1. Field of the Invention

This invention relates to a method for making titanium horseshoes that have excellent heat and corrosion resistance, are light compared to traditional horseshoes, and are very strong. These new horseshoes provide protection against injury and infection and help ameliorate any existing injury or infection in the hoof of a horse wearing the horseshoes of my present invention.

2. Description of the Prior Art

Since, the commercial introduction of titanium and titanium alloys in the early 1950's, these materials rapidly became a staple material for components used in the aerospace, energy, and chemical industries. The combination of a high strength-to-weight ratio, excellent mechanical properties, and corrosion resistance makes titanium the best material for many critical applications. The use of titanium has expanded in recent years from applications in nuclear power plants to food processing plants, from oil refinery heat exchangers to marine components and medical prostheses to static and rotating gas turbine engine components, as well as to highly stressed civilian and military airframe parts.

However, titanium components are expensive and their cost has limited the use of titanium to applications that justify the high cost of this material. Specifically, titanium is used in those applications where lower cost materials, such as aluminum and stainless steels, do not provide satisfactory results.

The relatively high cost of titanium results from the intrinsic raw material cost of titanium, its fabricating costs, and, the costs of removing titanium incurred in obtaining the desired end-shape. To make titanium components more competitive, those of ordinary skill have focused their efforts on the development of net shape or near-net shape technologies. These titanium net shape technologies include powder metallurgy (PM), super plastic forming, precision forging, and precision casting. Precision casting is by far the most fully developed and the most widely used net shape technology.

Those of ordinary skill believe that titanium castings, unlike those made from other metal, are not inferior to, but instead are comparable or superior to wrought products in all respects. For instance, those of ordinary skill believe that properties associated with crack propagation and creep resistance in titanium castings are superior to these properties in wrought titanium products. As a result, those of ordinary skill have substituted titanium castings for forged and machined parts in many demanding applications.

The utility of titanium castings is due to several unique properties of titanium. For example, an $\alpha+\beta$-to-$\beta$allotropic phase transformation occurs in the temperature range of 1300° to 1900° F. (705° to 1040° C.), which is well below the solidification temperature of such materials. As a result, during the solid state cooling, the cast dendritic $\beta$ structure is lost, leading to an a $\alpha+\beta$ platelet structure, which is also typical of $\beta$ processed wrought material. Further, the convenient allotropic transformation temperature range of most titanium materials enables the as-cast microstructure to be improved by means of post-cast cooling rate changes and subsequent heat treatment.

Nonetheless, titanium is highly reactive at elevated temperatures. This reactivity makes diffusion bonding easy. As a result, hot isostatic pressing (HIP) of titanium castings yields components with no subsurface porosity. At the HIP temperature range of 1500° to 1800° F. (820° to 980° C.), titanium dissolves any microconstituents on its internal pore surfaces, healing the porosity produced by casting as the pore surfaces collapse during the pressure and heat cycle. As titanium's mechanical properties are improved by (i) eliminating its casting porosity and (ii) developing a favorable microstructure, HIP makes titanium castings more desirable. However, titanium's high reactivity, especially in the molten state, presents a special challenge to the foundry. Special, and sometimes relatively expensive, methods of melting, mold making, and surface cleaning may be required to maintain metal integrity.

Although titanium is the fourth most abundant structural metal in the earth's crust (0.4 to 0.6 wt. %), it has emerged only recently as a technical metal. The high reactivity of titanium mandates complex processing methods. For example, from 1930 to 1947, most metallic titanium was processed into useful shapes by PM methods to avoid having to work with highly reactive molten titanium. Moreover, separating titanium from its oxide ores is very expensive. Specifically, separating titanium from its oxides requires, on a per ton basis, 1.7 times the amount of energy required to purify aluminum and 16 times the amount of energy to purify the components of steel. The combination of the processing complexities and the high cost have worked together to limit the appeal of titanium.

To address these difficulties, several foundries developed various approaches such as the proprietary lost wax ceramic shell systems for titanium castings. Of necessity, these shell systems must be relatively inert to molten titanium and cannot be made with the conventional foundry ceramics used in the ferrous and nonferrous industries. Usually, the face coats are made with special refractory oxides and appropriate binders. After the initial face coat ceramic is applied to the wax pattern, more traditional refractory systems are used to add shell strength from repeated backup ceramic coatings. Regardless of face coat composition, some metal/mold reaction inevitably occurs from titanium reduction of the ceramic oxides. The oxygen-rich surface of the casting stabilizes the phase, usually forming a metallurgically distinct $\alpha$ case layer on the cast surface, which may be removed later by means of chemical milling.

Foundry practice focuses on methods to control both the extent of the metal/mold reaction and the subsequent diffusion of reaction products inward from the cast surface. Diffusion of reaction products into the cast surface is a function of time and temperature. Depth of surface contamination can vary from nil on very thin sections to more than 0.06 in (1.5 mm) on heavy sections. On critical aerospace structures, the brittle "$\alpha$" case is removed by chemical milling. The depth of surface contamination must be taken into consideration in the initial wax pattern tool design.

Technical limits are not the only considerations in working with titanium. In such work, an initial inquiry is determining what limits are imposed by the technology and which limits are imposed by the end user. End user limits vary greatly with the field of application.

The raw material of the titanium ingot, the so-called titanium sponge, is produced in a complex process which may include a considerable percentage of titanium scrap.

The conventional production route of a titanium-ingot using a compacted sponge electrode follows the steps outlined below:

Analysis of sponge (for possible corrections)

Weighing and mixing (always one lot per compact) with alloying elements and scrap (max. 45%)

Producing compacts required in a hydraulic compacting press and storing them protected from ambient atmosphere Assembling, jigging and welding a consumable electrode together preferably with a stub in a Vacuum Plasma Welder Storing the welded electrode either in a desorption chamber or in a place heated well above ambient temperature in order to prevent absorption of moisture.

In view of the properties of titanium and its alloys, those of ordinary skill expected precision casting to yield useful titanium products. However, because of titanium's high melting point, i.e., higher than 2550° F. (1400° C.) and reactivity, melting and casting titanium has been problematic, at best.

Titanium alloys, and in particularly intermetallic compositions of titanium and aluminum, have a very desirable set of properties at higher temperatures. Intermetallic compositions of titanium and aluminum can be employed at temperatures of 1,000° F. (538° C.) and higher. One of the problems associated with the use of aluminides is that they tend to be somewhat brittle at room temperatures. However, recent developments have permitted the formation of modified titanium alloys which have desirable properties at elevated temperatures but which also have significant ductility at room temperature.

The strong tendency of hot, especially molten, titanium-based materials to absorb and react with oxygen commonly results in the material having a higher than acceptable oxygen content which renders the product outside of the required specifications. Molten titanium also absorbs and reacts with nitrogen and hydrogen.

Prior to the present invention, it was known that light horseshoes, particularly for use on racehorses and the like, were very desirable. For this reason, racehorses are usually shod with aluminum horseshoes. While aluminum horseshoes afford the desired lightness, they do not wear well and are weak. The average life for an aluminum horseshoe, on a racehorse, is approximately one month, compared to six weeks for a normal horseshoe. Moreover, aluminum, as well as steel, horseshoes corrode under field conditions and both types of horseshoes are very good at conducting heat. This corrosion and heat is now believed to at least retard healing, if not actually promote injury to horse hoofs.

Numerous innovations for titanium have been provided in the prior art that are adapted to the purpose for which the titanium is to be used. Even though these innovations may be suitable for the specific individual purposes which they address, they would not be suitable for the purposes of the present invention as heretofore described.

SUMMARY OF THE INVENTION

The present invention provides an improved titanium horseshoe, a method for making the improved horseshoe and the use of a horseshoe comprising mostly titanium to provide hoofs with protection and aid in their healing. More particularly, this invention provides an improved titanium horseshoe that avoids the disadvantages of the prior art on a cost-effective basis.

Additionally, this invention reduces titanium waste in producing horseshoes by forging.

This invention also results in a horseshoe that is extremely malleable so that it easily conforms to the natural contour of a horse's hoof, said hoof being generally, but not completely or perfectly, flat. Heretofore, the prior art has not been able to provide these benefits.

This invention provides a titanium horseshoe that is consistent and uniform in shape, strength and other important properties required for horseshoes. Additionally, using the process of the present invention, titanium horseshoes can be manufactured economically in the various sizes and shapes, and in the quantities necessary to compete in the horseshoe market.

Another aspect of the instant invention is a horseshoe that is as light as aluminum, substantially as strong as steel, but is more wearable than either aluminum or steel horseshoes. Moreover, as a result of the improved properties, a horse may not need to be shod as often.

The present invention also provides a method for making forged titanium horseshoes.

The present invention additionally provides a method of producing horseshoes having a superior set of properties.

The invention relates to the material and process of fabricating horseshoes out of titanium metal or titanium composites. Specifically, the invention relates to making horseshoes by forging titanium into superior horseshoes in a process effective to eliminate the need for removing contaminating gases such as oxygen, nitrogen and hydrogen.

Importantly, prior to the present invention, most horseshoes have been made of either steel or aluminum despite the drawbacks of these materials, which include the excessive weight of steel, weakness of aluminum, and the galvancy and corrosive allergic reactivity to the hoof tissue in the stable and field environment of both steel and aluminum.

This invention is directed to solving problems of the prior art. These problems are solved by a process of forging titanium while preventing the metal from contaminating reactions with gases such as oxygen, nitrogen and hydrogen. Forging the metal under conditions effective to prevent the metal from reacting with environmental gases even when the titanium has a high melting point or high activity due to the presence of as tungsten, molybdenum, vanadium, zirconium, lithium and the like allows the forging to take place at a low temperature.

The invention may be applied to all types of horseshoes, including as examples, shoes used for training, racing and jumping. In general, horseshoes made according to the invention will differ in composition, shape and configuration from ordinary horseshoes by virtue of the characteristic relationship of the titanium or titanium alloy between its strength, weight, and other favorable properties. For instance, a titanium horseshoe, because of its greater strength, can be thinner (and thus lighter) than an aluminum horseshoe of the same strength, or such a horseshoe might be only slightly thinner, only slightly lighter, but stronger than an aluminum horseshoe.

Cold working the horseshoe may be necessary, when fitting the horseshoe to a horse's hoof for a perfect fit and it may also be necessary to heat the horseshoe slightly to assist this fitting. Once in place on the horse's hoof, the normal action of the hoof on the ground as the horse moves will continue cold working and strengthening the horseshoe. However, because of titanium's considerable elasticity, the titanium horseshoe will wear better than horseshoes made from other metals.

The instant invention makes horseshoes from titanium that differ significantly from those that have been heretofore available, including those disclosed in my prior patents.

Moreover, the instant invention sets forth a new and unique process for making titanium horseshoes in a more cost effective manner than has been heretofore possible.

Accordingly the horseshoe of the instant invention has the desirable features of:

a. lightweight b. high strength c. flexibility d. excellent wearing qualities e. abrasion resistance f. workability g. formability h. reduced heat conductivity i. hypoallergenic j. physiologically inert While these properties are also present in the horseshoes I previously disclosed, my new horseshoes represent a significant improvement over my prior horseshoes.

Further benefits of the instant invention of titanium horseshoes will become apparent hereinafter.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

DETAILED DESCRIPTION OF THE PREFERRED EMBODIMENTS

Figure 1:
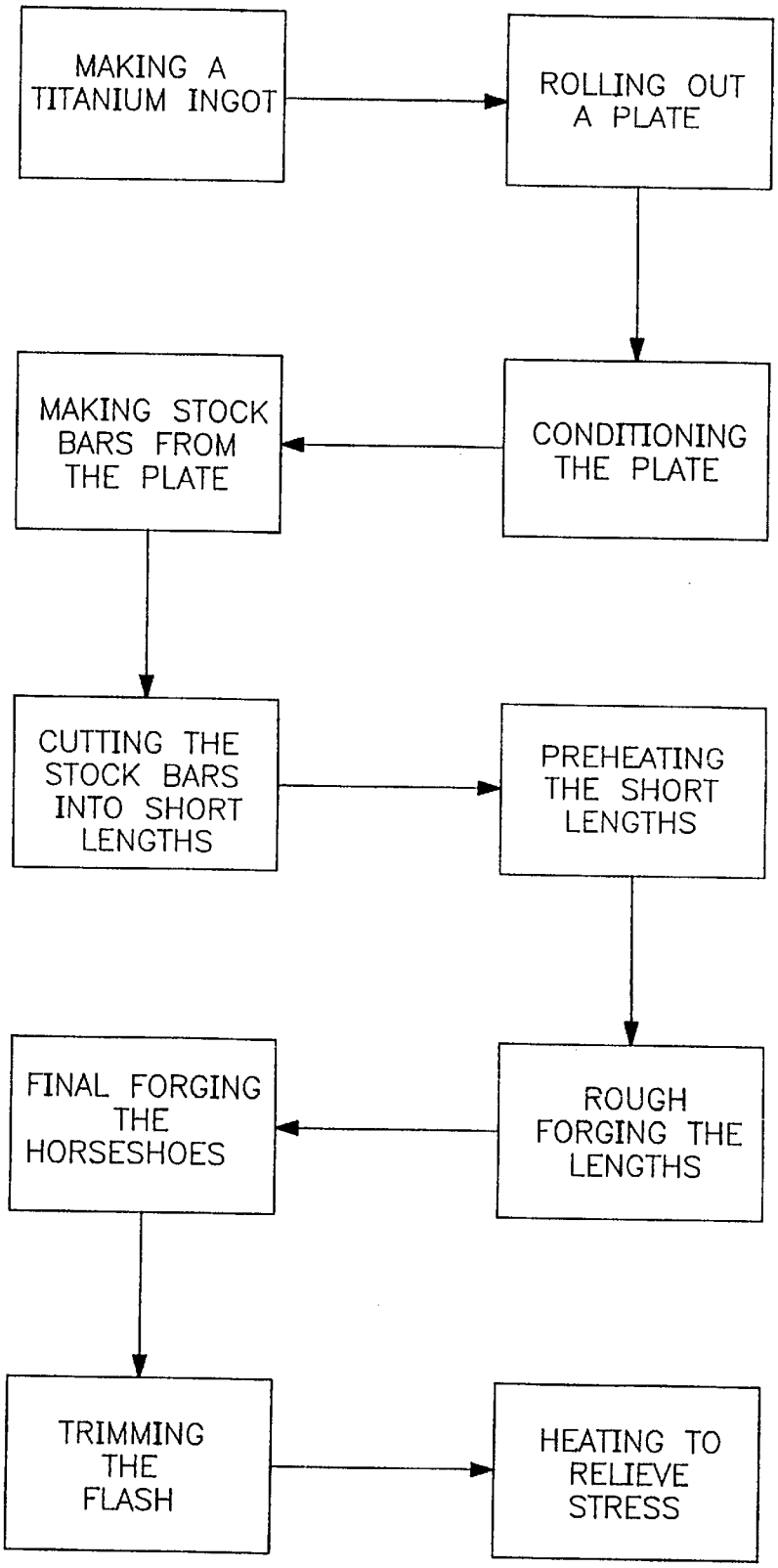
FIG. 1 is a schematic diagrammatic flow chart illustrating one embodiment of the forging of titanium horseshoes.

A preferred embodiment of the present invention comprises forging an improved horseshoe and is shown in FIG. 1. This horseshoe can be constructed of titanium in the following manufacturing process:

a) making a titanium ingot;

b) rolling said titanium ingot and making a titanium plate;

c) conditioning said plate (conditioning includes deburring, grit blasting and pickling);

d) preparing stock titanium bars from said plate;

e) preparing precut lengths of said stock titanium bars and bending said precut lengths into a shape approximating a horseshoe, i.e., a c-shape;

f) preheating said precut lengths of said stock titanium bars;

g) forging said heated precut lengths to a shape approximating a horseshoe;

h) forging said approximately horseshoe shaped titanium in a die into a horseshoe;

i) trimming the flash from said horseshoe; and j) relieving any stress in said trimmed horseshoe by heating.

The process for making horseshoes of the present invention desirably uses unalloyed titanium. Typically, unalloyed titanium comprises at least about 98.9 percent titanium. It is further desired that the titanium used in making horseshoes of the present invention is at least as pure as commercially pure titanium of grade 4. It is still further desired that the titanium used in this process is at least as pure as commercially pure titanium of grade 2.

Typically, the titanium used in the process of the present invention for making horseshoes begins with the casting of slabs or ingots of commercially pure titanium. Such ingots can be of any size that can be subsequently worked. However, ingots of about 12 in. (30.5 cm.)×44 in. (112 cm.)×150 in (380 cm.) are usually chosen.

The commercially pure titanium ingot is typically hot rolled into a ½ in. (1.25 cm.) thick sheet, or plate, either directly or after first making an intermediate bloom with an approximately 5 in. (12.5 cm) thickness. The plate is then processed to make titanium bars with an approximately ½ in. (1.25 cm) square cross section. While the plate can be made into bars by any conventional means, rolling and shearing are desirable means of converting the plate into titanium bars for use in the process of the present invention for making horseshoes. It is anticipated that by rolling or shearing the plates into bars one or more of the steps of pickling, annealing and grinding can be eliminated.

In an alternative embodiment of the process of the present invention for making horseshoes, the commercially pure titanium is extruded into a bar with an approximately ½ in. (1.25 cm) square cross section. It should be noted that the geometry of the cross-section can vary from a square.

In one embodiment of the process of the present invention, the titanium bar used to make the horseshoes is deburred desirably to a round, smooth edge, at this point in the process. The bars can also be straightened at this point in the process if desired. The deburring and straightening steps remove irregular surface patterns and rounds comers of the bar which is believed to prevent cracks or tears forming during the subsequent processing of the titanium.

In a typical embodiment of the process for making horseshoes of the present invention, the titanium bars are first cut into stock bars of about 20 ft (6.1 m.) lengths. Subsequently, these stock bars are cut into lengths sufficiently large to fill the forging dies with, desirably, as little excess as possible. Typically these lengths are between about 8 and 12 inches (22 and 30 cm).

Precut titanium bars made by other forging processes can be substituted for the above-described bars.

Desirably, these precut lengths of a titanium bar are preheated to at least about 750° F. (400° C.), preferredly to between about 800° and 1500° F. (425° and 815° C.), and more preferredly to between about 800° and 1100° F. (425° and 600° C.). However, it is important that the titanium bars are kept below the melting temperature of the titanium throughout the process of the present invention. Desirably, the titanium bars are kept below about 2000° F. (1100° C.) throughout the process of the present invention, and more desirably below about 1800° F. (980° C.) throughout the process of the present invention. Among things, this control of the temperature of the titanium is believed to avoid oxidation and other reactions of the titanium with gases in its environment.

The precut lengths of titanium which desirably have been heated are then forged. In a preferred embodiment of the present inventive method of making titanium horseshoes, the precut lengths are bent in a first forging step into curved shape. Desirably, the curved shape approximates the shape of the horseshoe into which the titanium is to be formed. This first forging step typically takes place at a temperature between about 1400° and 2150° F. (760° and 1180° C.), and desirably between about 1500° and 1700° F. (815° and 925° C.). This first forging step can be done using conventional power brake forming or stretch forming techniques.

Alternatively, this bending or first forging step can be done cold.

The horseshoe is formed in a horseshoe die which is desirably made from tooled steel. The precut titanium, preferably the bent precut titanium is placed on a die. In one embodiment of the process for making horseshoes of the present invention, the precut titanium is placed in a gas forge, then after the precut titanium is placed in a die and using a hammer of about 500 to 5000 lbs. (230 to 2270 kilo), and preferably about 1200 to 1500 lb. (545 to 680 kilo), to apply a pressure to the titanium sufficient to shaped it into the desired horseshoe shape. The titanium in this process is also typically between about 1400° and 2150° F. (760° and 1180° C.), and desirably between about 1500° and 1700° F. (815° and 925° C.).

In an alternative embodiment of the present invention, the horseshoe is shaped in a press forge operating at about 500 tons to 1500 tons, and desirably between about 600 and 800 tons.

Desirably, the horseshoe dies are heated before the precut titanium blank is placed in the dies.

After the shaped titanium is removed from the molding die, the flash is removed in a conventional fashion such as by the use of a trimming die or by machining. Additionally, any desired holes in the horseshoes are desirably added at this time by drilling or punching. Typically, a horseshoe will have holes for the nails used to affix the horseshoe to the hoof of a horse. It is preferred that any holes are added by punching. It is also desirable that any surface imperfections are removed from the horseshoes. The removal of the flash and the addition of the holes can be done in successive steps, or both can be done in a single step using, for instance a trimming die that contains the hole punches.

If desired, the horseshoe can be reheated at this time. For instance, the horseshoe can be reheated at this time to relieve stress, or to ensure that the titanium is fully annealed. Any such reheating should be done between about 1000° and 1700° F. (538° and 925° C.), desirably between about 1000° and 1300° F. (538° and 700° C.), and more desirably between about 1000° and 1100° F. (538° and 600° C.) for stress relief and between about 1250° and 1350° F. (675° and 730° C.) to anneal. Typically, if the reheating is to relieve stress, it is for at least about 30 minutes, thereafter, the horseshoes are allowed to air cool. When the reheating is to fully anneal the horseshoe, the reheating is done at about 1300° F. (700° C.) for between about 30 and 120 minutes, after which the horseshoes are allowed to air cool.

In an alternative embodiment in which the titanium is forged into horseshoes at temperatures less than about 1200° F. (650° C.), the horseshoe is desirably annealed after forging.

The process for making horseshoes of the present invention can be carried out under ambient or other conventional atmospheric conditions found about a forge. In other words, unlike the means of making titanium horseshoes heretofore known, the process for making horseshoes out of titanium of the present invention does not require the exclusion of any of the gases that react rapidly with titanium at elevated temperatures. The ability of the process of the present invention to work with the titanium under substantially any atmospheric composition makes the inventive process easier than those processes heretofore known to those of ordinary skill in the art for making titanium horseshoes.

The horseshoes of the present invention have substantially all of their crystalline titanium in the α-phase and are substantially free of air voids, problems found in titanium products made using PM or casting. Furthermore the dendritic structure of the titanium is refined over that of the ingot used at the beginning of the process and the horseshoe typically has a fiber structure that parallels the horseshoe's shape. This characteristic is also reflected in a directional alignment of the metal grains. Moreover, substantially all of the defects and pores in the initial ingot are removed. Specifically, titanium products made using PM, while useful, contain air voids and thus are weaker than a titanium product without such voids. Similarly, casting titanium produces a product that has a substantial P-phase, which phase also results in a product that is weaker than a titanium product in which the titanium is substantially all in the α-phase. Thus, it is believed that the titanium horseshoes of the present invention are substantially stronger than titanium horseshoes made by either PM or by casting are and these new horseshoes are as strong as titanium horseshoes can be.

Typically, a titanium horseshoe according to the present invention weights about 6 oz (170 gm) whereas a steel horseshoe weights about 12 and 16 oz. (750 and 1000 gm).

Steel and aluminum horseshoes, when on the hoof of a horse, tend to corrode. For example, when a horse shod with an aluminum horseshoe steps in urine, the urine reacts with the aluminum. Similarly, wet ground tends to lead to oxidation of steel horseshoes. In marked contrast to these traditional horseshoes, titanium horseshoes have a greater resistance to such corrosion. It is believed that horseshoe corrosion provides conditions suitable for the development of hoof disease such as white line disease. These conditions may be further aggravated by excellent heat transfer properties of steel and aluminum horseshoes. Specifically, steel and aluminum horseshoes transfer the heat generated by the friction of a horse's movement along the ground to the horse's hoofs. This heating can raise the temperature of the hoof by about 40° F. (22° C.) or more. It is now believed that replacing steel or aluminum horseshoes, most notably corroded steel or aluminum horseshoes, with corrosion resistant titanium horseshoes removes the corrosion irritation and reduces the heating of the horse's hoofs. This is believed to allow the horse's hoof to recover from hoof diseases, as well as help prevent such disease conditions from developing in the first instance.

In another example of a preferred embodiment of the present invention is the manufacturing process comprising forging resulting in an improved horseshoe from commercially pure titanium, the titanium is kept at an elevated temperature by immersing said titanium in a heat bath throughout the intervals in the processing.

The present invention also comprises the use of titanium horseshoe nails to secure a horseshoe to a horse. While any conventional horseshoe can be secured to a horse using the titanium horseshoe nails, it is preferred that the inventive nails are used to secure titanium horseshoes, or other horseshoes that have a heat conductance, specific gravity, strength, corrosion resistance and substantially physiological inertness approximating that of titanium, to a horse. While the inventitive titanium horseshoe nails can be made by any process that can form titanium into the required shape, it is preferred that conventional forging techniques are employed to make the titanium horseshoe nails of the present invention.

It is believed that the use of the inventive titanium horseshoe nails will further aid the preventative and promotion of healing found with titanium horseshoes. Specifically, it is believed that the use of titanium horseshoe nails reduces heat conduction to the horse's hoof, reduce the weight of the horseshoe-nail combination, does not corrode under field conditions which is observed in many conventional horseshoe nails, and is physiologically inert. The physiological inertness is more important with the nail than with the horseshoe as the nail is inserted into the hoof whereas the horseshoe merely sits next to the hoof.

While the invention has been illustrated and described as embodied in an improved titanium horseshoe, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What I claim is:

1. A forged titanium horseshoe comprising:

a. at least about 98.9 percent titanium;

b. an $\alpha$ crystal structure; and c. a grain fiber that substantially follows the shape of the horseshoe.

2. The forged titanium horseshoe of claim 1 in which substantially all of the titanium crystals are in the $\alpha$ phase.

3. The forged titanium horseshoe of claim 2 substantially free of voids.

4. The forged titanium horseshoe of claim 1 having a strength greater than that of a cast titanium horseshoe.

5. The forged titanium horseshoe of claim 1 having a strength greater than that of a titanium horseshoe made using powder metallurgy.

* * * * *